US005284404A

United States Patent [19]

Hu

[11] Patent Number: 5,284,404

[45] Date of Patent: Feb. 8, 1994

[54] MOVING STEEL FORM SYSTEM

[76] Inventor: Ming C. Hu, No. 1, Lane 109, Ta Kuang Road, Sec. 2, Pan Chiao City, Taipei Hsien, Taiwan

[21] Appl. No.: 861,279

[22] Filed: Mar. 31, 1992

[51] Int. Cl.[5] ..... E21D 9/00

[52] U.S. Cl. ..... 405/142; 405/145; 405/293; 405/291; 405/288

[58] Field of Search ..... 405/146, 147, 148, 142, 405/145, 150.1, 150.2, 288, 290, 271, 291, 293

[56] References Cited

U.S. PATENT DOCUMENTS

| | | | |
|---|---|---|---|
| 3,417,538 | 12/1968 | Dean | 405/146 X |
| 3,550,344 | 12/1970 | Maier et al. | 405/146 X |
| 3,812,680 | 5/1974 | Walbröhl | 405/290 |
| 3,970,200 | 7/1976 | Goetjen | 405/148 X |
| 4,043,137 | 8/1977 | Jütte et al. | 405/146 |
| 4,050,255 | 9/1977 | Ahlgren | 405/146 X |
| 4,826,639 | 5/1989 | Vidal et al. | 405/146 X |

*Primary Examiner*—Randolph A. Reese
*Assistant Examiner*—J. Russell McBee
*Attorney, Agent, or Firm*—Wenderoth, Lind & Ponack

[57] ABSTRACT

A travelling steel form system includes a three-dimentional framework mechanism with multiple faces crossing and coupling with one another. A set of form panels are fixed to the outer side of the framework mechanism on more than two faces thereof, and are capable of connecting to one another to form a predetermined shape and disconnect from one another to change the shape following expanding and retracting movement of the framework mechanism. A driving device is vertically or horizontally retractably mounted on the front end and or rear end of the framework mechanism for driving the latter to perform movements of expanding the outer diameter or reducing the outer diameter. The system is particularly suited for use in concrete placing work in civil engineering constructions.

10 Claims, 3 Drawing Sheets

MOVING STEEL FORM SYSTEM

FIELD AND BACKGROUND OF THE INVENTION

The present invention relates to a travelling form structure and, more particularly, to a form construction system adapted for use in concrete placing work in such civil engineering constructions as tunnels, culverts, trenches and underground tunnels for form support of concrete paste that has been deposited.

Traditionally, early in civil engineering constructions, wooden boards and braces were utilized as form structures for form support during concrete grouting in the excavation and digging in such works as, for example, tunnels, culverts, trenches or underground tunnelings. Nowadays, for timbering strength and repeated use, form structures are assembled and set up with mostly steel boards together with steel bracings and steel supporting struts. However, because these steel form structures are heavy and clumsy to set up, and also because connections between the individual steel form boards must rely on extensible bolts and screws for vertical as well as transverse interdependency and fitting, the construction work has been rather redundant and time-consuming. When grouting has been completed and the concrete has attained an early hardening strength, the dismantling of the form structures must proceed immediately in order to remove the members of the form boards that have been dismantled to the next section for continuity of the construction. Since the processes of form dismantling, separating, transporting, reassembling and mounting are repeated again and again, it has been time consuming and laborious. Particularly, when mounting of the form structures has been completed and most of the working space has been occupied by vertically and transversely setting up the links and braces, there is little possibility for effective use of those spaces to proceed with construction or work for the next section. As a result, it greatly effects the effective rate of the construction and the work completing period.

SUMMARY OF THE INVENTION

Today, at a time when labor expenses are high and there is a shortage in workers, while much emphasis is being laid on deadlines for projects, to devise a set of complete, labor-saving and rational steel form construction systems while achieving the objects of automation and simplification in the operating process of the structures, has therefore been a task of urgent necessity for the industry.

Accordingly, it is an object of the present invention to provide a novel moving steel form system in which a framework structure comprising form panels and supports form a linkage-like integral construction and where, when the form panels are set up, assembled or dismantled, they do not require manual turning one by one of a number of turnbuckles and members of the form panels and strutting pieces all work automatically in stretching out or retracting, thereby making it possible for manual labor and construction costs to be saved and the working period reduced.

It is a further object to provide a moving steel form system which, by to expansion action of an oil pressure pump mounted on the framework structure, is capable of bringing the form panel structures into a mutual linked action in expansion on multiple faces, and also, by the front and the rear ends of the framework structure being temporarily and alternately fixed, is capable of bringing the entire set of the steel form device into an automatic crawling action thereby accomplishing travel without having to provide for a separate driving unit.

It is yet another object of the invention to provide a moving steel form system the basic joint units of which are capable of bending in a small range so that the entire device is also suited for use in concrete construction work of nonlinear curved tunnels.

It is yet an additional object of the invention to provide a moving steel form system the basic joint units and form panels of which can be used repeatedly and can be adapted for use on different sections, requiring modification or deformation on a small scale only.

It is yet a different object of the invention to provide a moving steel form system in which the basic joint units are simple in construction and easy to design, and can be linked in any desired number of joints and used any time with an increase or decrease in number according to need, and can be applied to uses in other construction work, such as object lifting and transportation other than cutting dies.

A further object of the present invention is to provide a moving steel form system in which coupled rail joints can be provided on the interior of the form structure to permit a muck car to pass through during a period of depositing concrete, and to carry out excavation processes deep into the front section, thereby greatly shortening the time set for any construction work.

A still further object of the present invention is to provide a moving steel form system where each steel formwork mechanism is so designed that several sets of the mechanisms work simultaneously and are capable of passing through each other, thereby greatly raising the efficiency in construction and cutting down much of the time set for the construction work.

Another object of the present invention is to provide a moving steel form system in which the level can be lowered down to a minimum during inspection and maintenance to facilitate the maintenance or repair work thereof.

BRIEF DESCRIPTION OF THE DRAWINGS

Other objects and advantages of the present invention will become apparent from the following detailed description of preferred embodiments thereof in connection with the accompanying drawings, in which.

DETAILED DESCRIPTION OF THE INVENTION

Figure 1:
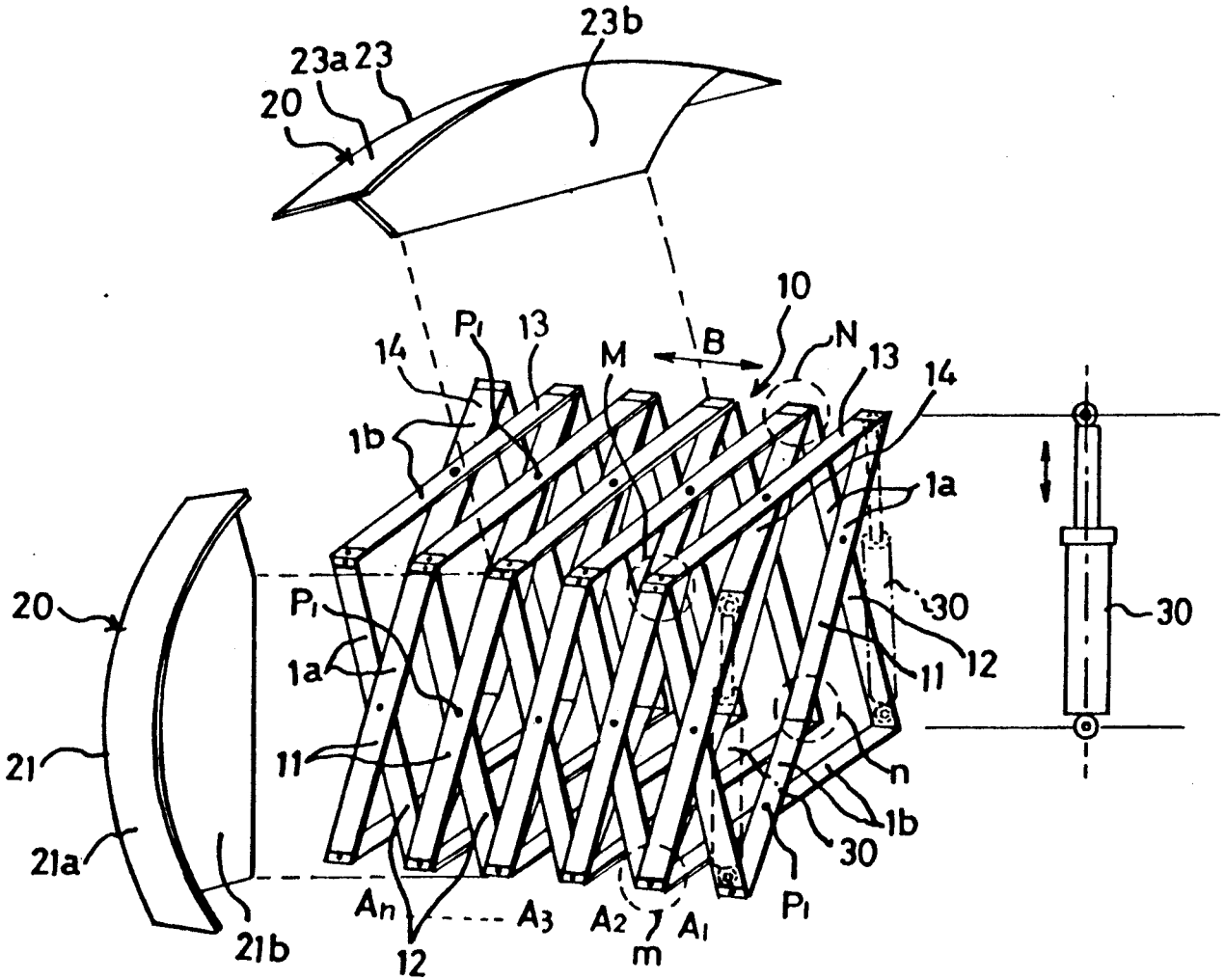
FIG. 1 is a perspective view of a steel form system of the present invention in a semi-extended state.

There is shown in FIG. 1 the basic construction of an embodiment of a movable steel form system of the present invention in a semi-extended condition. As can be seen from the drawings, the steel form system of the invention comprises, basically, a three-dimensional framework mechanism 10 having a plurality of crossing faces capable of linking up to act as supporting frame, a set of form panels 20 fixed to the frame assembly 10 on at least one face, and usually on several faces, and capable of linking up together to form a preformed shape or separating out from one another following the unfolding and enlarging or withdrawing and stretching of the frame assembly 10, and a driving device 30 vertically or horizontally retractably located at the front end and/or rear end of the frame assembly 10 for driving the frame assembly 10 to perform expanding and enlarging or withdrawing and contracting actions.

Figure 2A:
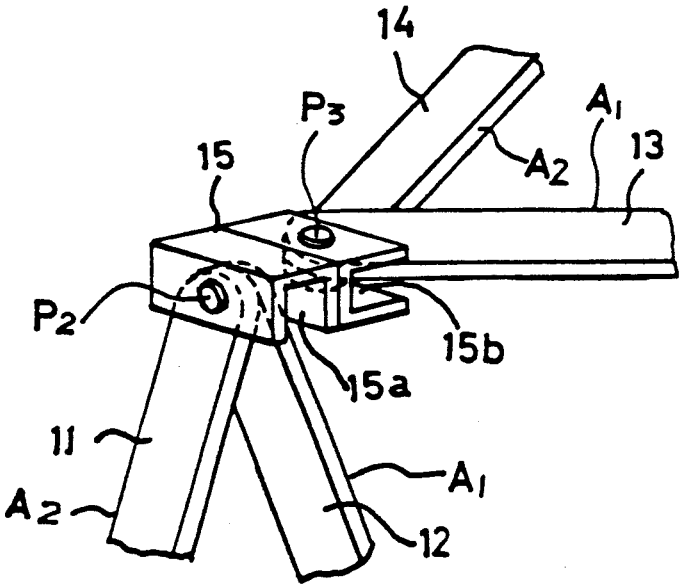
FIGS. 2A through 2C are illustrations showing various pivot connecting parts of a framework mechanism.

The framework mechanism 10 includes at least a set of three-dimensional multi-faced cross link basic units $A_1$, $A_2$, $A_3$ . . . . Each set of link units $A_1$, $A_2$ . . . comprises a pair of lateral cross linkages 1*a* on left and right sides having two vertical connecting rods or links 11 and 12 pivotably connected to each other at the center by pins $P_1$, a pair of upper and lower cross linkages 1*b* having two horizontal connecting rods or links 13 and 14 pivotably connected to each other at the center by pins $P_1$ and a frame pivot member 15 for pivotably connecting the two ends of the upper, lower, left and right cross linkages 1*a* and 1*b* by pins $P_2$ and $P_3$. Referring to FIG. 2A, the pivotal condition in each of the cross linkages 1*a* and 1*b*, using an example at M, is described below. The interconnection in each of the cross linkages is achieved by inserting overlappingly the vertical link 12 from basic unit $A_1$ of the previous set and the vertical link 11 from basic unit $A_2$ of the adjacent rear set in a vertically directed groove 15*a* of the pivot member 15 and connecting the same with pin $P_2$. In addition, the horizontal link 13 from basic unit $A_1$ of the previous set and the horizontal link 14 from basic unit $A_2$ of the adjacent rear set overlap and are inserted in a horizontally directed groove 15*b* of the pivot member 15 and connected with each other by another pin $P_3$.

Figure 2B:
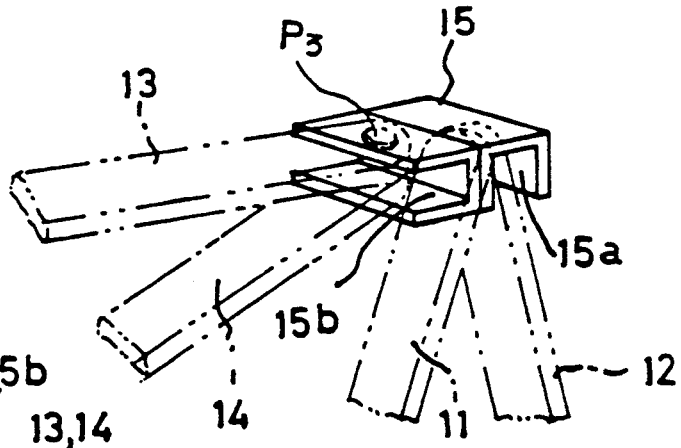

The construction of the pivot connecting portion as shown in FIG. 2A illustrates only the place designated at M. However, for a place designated at N on the opposite side, it requires only turning the pivot member 15 horizontally 180 degrees so that the groove 15*b* is inwardly directed and the groove 15*a* remains still downwardly directed as shown in FIG. 2B and as described above. The front and rear sets of links 11 and 12, and 13 and 14, are next inserted in the grooves 15*a* and 15*b*, respectively and pivotably connected by pins $P_2$ and $P_3$. At the lower places m and n, the pivot members 15 of FIGS. 2A and 2B are turned upside down to allow the groove 15*a* to be upwardly directed and the groove 15*b* to be horizontally directed. The links 11 and 12, and 13 and 14, as in the foregoing, are inserted in the grooves 15*a* and 15*b*, respectively, and may then be connected by pins $P_2$ and $P_3$.

Figure 2C:
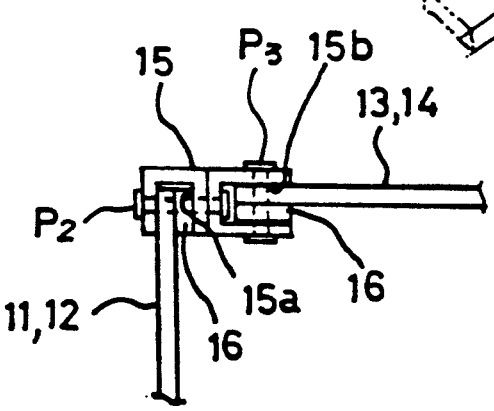

Regarding the links 11 and 12 and 13 and 14 at the four corners at the front most side of unit $A_1$ of the front most set and at the rear most side of unit $A_n$ of the rear most set of the framework mechanism 10, which are not connected to units of another set, the aforesaid pivot member 15 may be similarly utilized. However, because there is no overlapping and pivotal connection of other links in the grooves 15*a* and 15*b* the spaces left behind are thus being filled up, as shown in FIG. 2C, with packing sheets 16 equivalent in thickness to a link.

The framework mechanism 10 constructed as above possesses a plurality of sets of basic joint units $A_1$, $A_2$ . . . $A_n$ in continuous combination, including a left and right pair of cross linkages 1*a*, 1*a* and an upper and lower pair of cross linkages 1*b* pivotably cross-connected to each other to form three-dimensional four-sided links.

Figure 3:
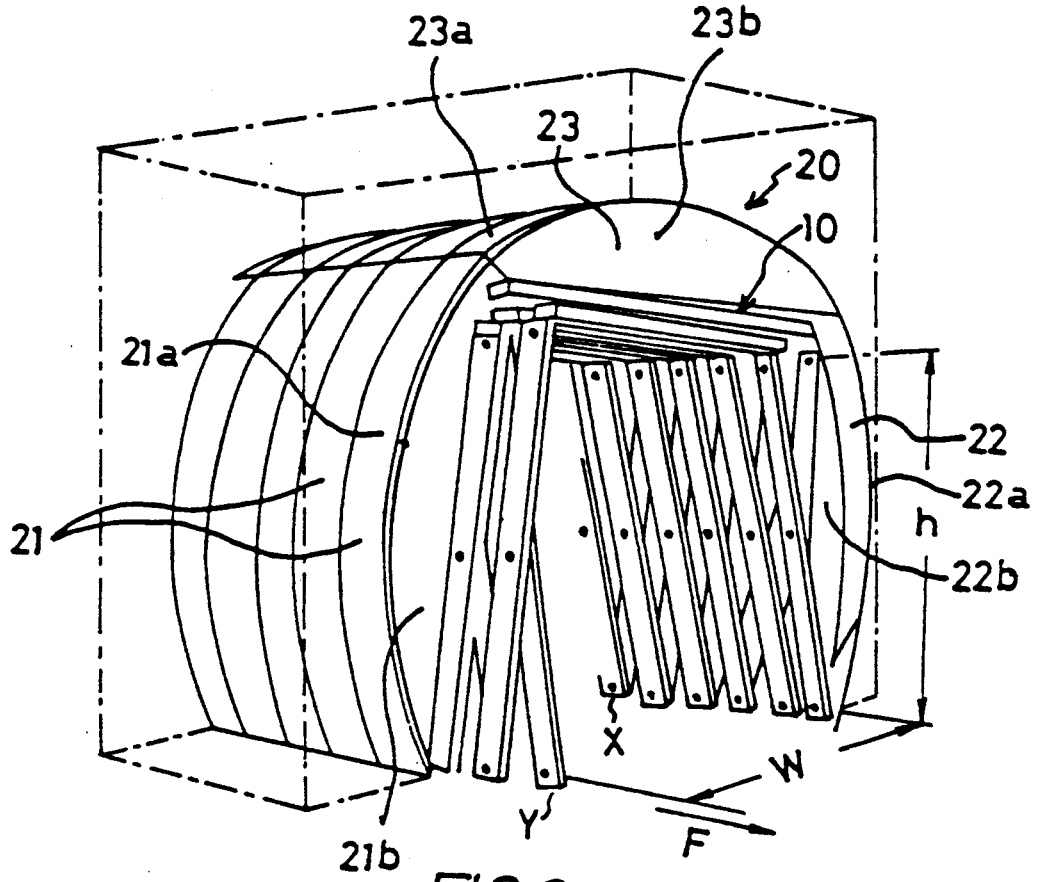
FIG. 3 is a partially perspective view of a steel form system in a retracted condition.

The panel assembly 20 includes a plurality of form panels 21, 22 and 23, which are fixed to the links at the outermost sides of the basic joint units $A_1$, $A_2$, . . . of the framework mechanism 10, that is, as shown in FIG. 1, to the non-parallel links 11 and 12 located at the two opposite sides and the link 13 on the uppermost side by fastening means such as screws, rivets, or welding. In the present embodiment, the panel assembly 10 is adapted for use on a cutaway cylindrical concrete placing structure having the bottom cut by a section of arc and of a plane shape. Therefore, each of the form panels 21, 22 and 23 is so formed that when the entire framework mechanism 10 extends and enlarges, and each of the units $A_1$, $A_2$ . . . comes close to each other, the form panels are brought close to one another on the front and rear and above and below to form curved form sheets of a closed inner sheeting in a tunnel or culvert. When all of the curved form panels 21, 22 and 23 have been drawn close to one another in the condition as shown in FIG. 3, concrete is then deposited on the outside thereof and a tunnel construction is thereby completed in an example as shown by the dotted line. Each of the form panels 21, 22 and 23 has a curved sheet a form board 21*a*, 22*a* and 23*a* and a fixing sheet 21*b*, 22*b* and 23*b* extending from each of the curved sheets toward each of the corresponding links 11, 12 and 13. As described above, the fixing sheets 21*b*, 22*b* and 23*b* are fixed to the vertical links 11 and 12 and the horizontal link 13 by welding. In this way, the form panels are capable of linking up along with the units $A_1$, $A_2$ . . . of the framework mechanism 10. Also, it is needless to say that these form panels may be changed into various forms according to the sectional shape actually needed.

The assembly structure of framework mechanism 10 and form panel set 20 constructed as the above may now serve as a substitute for conventional steel forms. However, in order that the steel form system of the present invention accomplishes by machines the changes from retraction and drawing-close of the units and enlargement of the section to extension and separation of the units and reduction of the section, a driving unit 30, such as a hydraulic pump or an electric screw bolt, is mounted on both sides or any one side at the front end of the front most basic unit $A_1$ of the framework mechanism 10 or on the upper and lower sides or any one side thereof to be capable of retracting in a vertical (up and down) direction or a horizontal (left and right) direction. In the present embodiment, the driving unit 30 uses, as an example, a pair of hydraulic cylinders, and the cylinders are vertically fixed at their upper and lower ends by pins $P_4$ to respective pivot members 15 at the upper end of the link 11 and at the lower end of the link 12. It is also possible that the pumps may be located on the driving unit fixing members additionally mounted at the upper end of the link 11 and at the lower end of the link 12 or on the pivot member 15 (not shown). It is preferred, however, to use only one pair of synchronously acting driving units 30 in order to enable the entire set of the steel form system to operate in a stable and balanced way. When the steel form system is rather large, there may be used one pair of the driving units at both the front and the rear of the framework mechanism 10. Under certain circumstances, when the steel form is small and light, however, one driving unit 30 is sufficient.

In the following, the operating condition is described as an example of where the construction is more difficult and thus requires use of a functionally more complex tunneling steel form.

Figure 4:
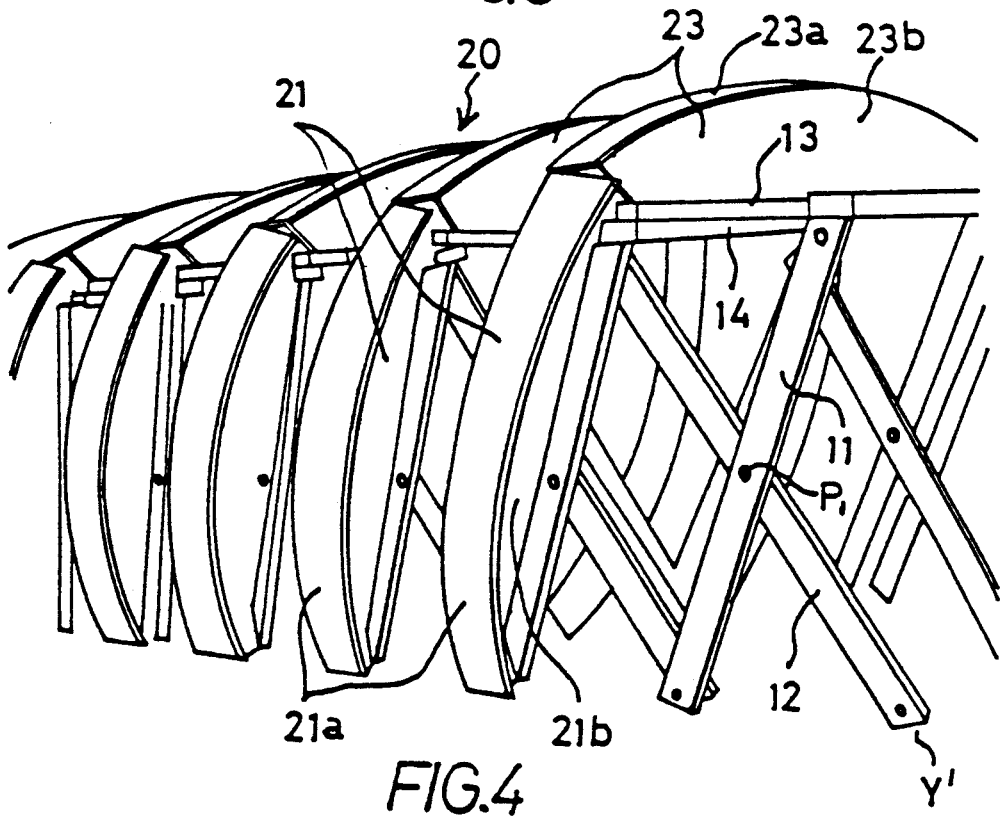
FIG. 4 is a partial perspective view of the steel form system in an extended and retracted condition.

First, under the condition as shown in FIG. 1, hydraulic pressure is forced with the hydraulic pump (not shown) into the cylinder 30 acting as the driving unit and moves the piston rod thereof to extend outwardly. The upper end of the link 11 is thereby pushed upwardly, which by means of pivot members 15 having the pins $P_2$, $P_3$ and $P_1$, respectively, as the center, couplingly moves the links 11, 12, 13 and 14 to be drawn close to one another. The form panels 21, 22 and 23, as in FIG. 3, are thus drawn close to each other to form a close tunnel inner sheeting. At this time concrete may be deposited in the space between the outer side of the steel form and the inner wall of the excavated tunnel, and after the concrete sets and has attained an initial strength capable of self-support, the steel form is then disconnected. Now, when a reverse hydraulic oil pressure is applied to allow the piston rod of the cylinder 30 to retract, the cross linkages 1*a* and 1*b* move couplingly, thereby forcing the framework mechanism 10 to extend along in the direction of the arrow B. The sets of curved form panels 21, 22 and 23 also start to separate from one another following the movement of the links. When the hydraulic cylinder has retracted a set length, the framework mechanism 10 stretches out to a state as shown in FIG. 4. This results in reduction changes in both height h and width w of the section of the framework mechanism, and further moves the form panels 21, 22 and 23 to retract inwardly, whereby the framework mechanism is released from the concrete structure. In this way, an automatic disconnection of the form structure is achieved.

Furthermore, the steel form system of the present invention can be moved without having to provide for an additional power source. In FIG. 3, the letter F represents the direction in which the system is to advance. The rear end of the framework mechanism 10 is somehow fixed at point X to the ground. When the hydraulic cylinder 30 is allowed to retract inwardly, this results in the head end of the framework mechanism 10 extending forwardly from point Y to point Y', as shown in FIG. 4. The framework mechanism 10 is the fixed at a next point Y' to the ground, and the original fixing in the ground at point X of the rear end is released. The hydraulic cylinder 30 is then extended further to thereby draw the rear end of the framework mechanism 10 at point X close to the head end at point Y. In this way, by repeating the reciprocating action continuously it allows the entire set of the framework mechanism to slowly crawl forwardly. Also, because of the design that sections are joined by pins $P_1$, $P_2$ and $P_3$, the framework mechanism 10 moves freely and is capable of bending slightly in a longitudinal way and is suited for use in nonlinear tunneling.

When the framework mechanism 10 has been lengthened, the sections retract to the minimum and are capable of crossing one another. Thus, under the condition when several sets of the framework mechanism are used simultaneously, before the steel form of the front section has been disconnected, the steel form of rear section is able to cross and advance forwardly to carry out construction work at the next section to thereby shorten the working period.

The framework mechanism according to the present invention is a basic joint structure, and it may be adapted for use in tunnels of different sectional sizes, requiring modification in the curved form panels only. The structure has a high rate of repeated uses, and saves in construction cost.

Furthermore, with the steel form system of the present invention, it is possible to attach additional numbers, or reduce the number of the basic joint unit A in the framework mechanism 10. Also, because the form panels 20 can be easily detached and replaced, this framework mechanism 10 may be suited for use with sets of the form panels 20 of different shapes.

I claim:

1. A travelling form system, comprising:

a three dimensional framework made up of a plurality of framework members that are connected together so as to define a plurality of outer faces and so as to form said framework to be capable of expanding and contracting in a longitudinal direction while reducing and enlarging, respectively, the cross-sectional area thereof in a cross-sectional plane perpendicular to the longitudinal direction;

form panels fixed to at least one said outer face of said three dimensional framework such that, when said three dimensional framework is contracted in the longitudinal direction so that the cross-section thereof is enlarged, said form panels are together to form a predetermined shape, and such that, when said three dimensional framework is expanded in the longitudinal direction so that the cross-section thereof is reduced, said form panels move apart from one another and change from said predetermined shape; and driving means mounted on said three dimensional framework for expanding said three dimensional framework in the longitudinal direction to reduce the cross-sectional area thereof and for contracting said three dimensional framework in the longitudinal direction to enlarge the cross-sectional area thereof.

2. The travelling form system of claim 1, wherein said three dimensional framework comprises at least one set of said framework members forming a basic unit, each said basic unit comprising:

two pairs of vertically extending framework members forming opposite vertical sides of said framework, each said pair having its two said framework members centrally pivotably connected to each other;

two pairs of horizontally extending framework members forming opposite upper and lower sides of said framework, each said pair of framework members being centrally pivotably connected to each other; and pivot connection members connecting the opposite ends of said two pairs of vertically extending framework members to respective ends of said two pairs of horizontally extending framework members.

3. The travelling form system of claim 1, wherein each said form panel comprises a sheet mounted to said framework members.

4. A travelling form system made up of at least one basic framework unit, said unit comprising:

two pairs of vertically extending framework members, each said pair of vertical framework members being centrally pivotably connected to each other; and two pairs of horizontally extending framework members, each said pair of horizontal framework members being centrally pivotably connected to each other;

wherein each end of each said framework member of said pair of horizontally extending framework members is pivotably connected to an end of a said framework member of said vertically extending framework members so as to define a framework capable of expanding and contracting in a longitudinal direction and having a plurality of outer faces;

said travelling form system further comprising a form panel fixed on an outer face of said framework defining a predetermined shape, and driving means mounted on said framework for expanding said framework in the longitudinal direction and simultaneously reducing the cross-sectional area thereof, and for contracting said framework in the longitudinal direction and simultaneously enlarging the cross-sectional area thereof.

5. The travelling form system of claim 4, wherein a plurality of said basic framework units are connected to each other, and wherein said framework has four said outer faces defined by respective sets of parallel links, said parallel links being formed by said framework members.

6. The travelling form system of claim 5, wherein each said basic framework unit has a said form panel thereon.

7. The travelling form system of claim 5, wherein each said form panel comprises a form sheet defining said predetermined shape and a fixing sheet fixing said form sheet to said basic unit.

8. The travelling form system of claim 5, wherein said basic framework unit has a said form panel on upper, left and right said outer faces thereof.

9. The travelling form system of claim 5, wherein said driving means comprises a piston and cylinder device connected with said parallel links.

10. The travelling form system of claim 5, wherein said ends of said framework members are pivotably interconnected by pivot members, each said pivot member defining two grooves disposed at 90° relative to each other, and each said grooves being capable of pivotably receiving the ends of two said framework members.

* * * * *